United States Patent [19]

Bixel et al.

[11] Patent Number: 4,783,200

[45] Date of Patent: Nov. 8, 1988

[54] METHOD FOR PASSIVATING LOW RANK DRIED COAL

[75] Inventors: John C. Bixel, Newtown, Pa.; Michael J. Dabkowski, Mickleton, N.J.

[73] Assignee: Mobil Oil Corporation, New York, N.Y.

[21] Appl. No.: 59,369

[22] Filed: Jun. 8, 1987

Related U.S. Application Data

[63] Continuation-in-part of Ser. No. 858,621, May 1, 1986, abandoned, which is a continuation-in-part of Ser. No. 798,513, Nov. 15, 1985, abandoned, and a continuation-in-part of Ser. No. 810,116, Dec. 18, 1985, abandoned, which is a continuation-in-part of Ser. No. 798,513, Nov. 15, 1985, abandoned.

[51] Int. Cl.[4] ..... C01L 5/00; C01L 5/24

[52] U.S. Cl. ..... 44/501

[58] Field of Search ..... 44/1 R, 1 G, 6, 501

[56] References Cited

U.S. PATENT DOCUMENTS 4,201,657 5/1980 Anderson et al. ..... 44/6

*Primary Examiner*—Carl F. Dees

*Attorney, Agent, or Firm*—Alexander J. McKillop; Michael G. Gilman; Van D. Harrison, Jr.

[57] ABSTRACT

Coal is rendered less subject to abrasion and disintegration by reducing it to a 0.2 to 0.5-inch particle size and drying it at a temperature of 200° to 230° F. for 3–7 minutes. The coal is rendered less susceptible to spontaneous ignition by the application of a treating agent which is a petroleum resid mixed with clarified slurry oil or a petroleum resid mixed with a distillate.

9 Claims, No Drawings

METHOD FOR PASSIVATING LOW RANK DRIED COAL

CROSS-REFERENCE TO RELATED APPLICATIONS

This is a continuation-in-part of copending application Ser. No. 858,621, filed May 1, 1986 (abandoned), which is a continuation-in-part of Ser. No. 798,513, filed Nov. 15, 1985 (abandoned) and a continuation-in-part of Ser. No. 810,116, filed Dec. 18, 1985 (abandoned), which is a continuation-in-part of the Ser. No. 798,513, filed Nov. 15, 1985 (abandoned) application, all of which are incorporated herein by reference.

NATURE OF THE INVENTION

This invention relates to improved methods for producing a dried particulate coal fuel having a reduced tendency to ignite spontaneously. More specifically, it relates to a method for drying coal, particularly low rank coals, and rendering them less susceptible to spontaneous ignition.

BACKGROUND OF THE INVENTION

Although low sulfur, sub-bituminous coal is readily available it may have such a high moisture content and low heating value that it is of little use as a fuel in existing boilers. Thermal drying to reduce the moisture content of the coal can upgrade its heating value to a point where the dried coal can compete favorably with many bituminous coals. With a low sulfur content such coal can meet clean air requirements for many power plants and make a major contribution to reducing sulfur dioxide emissions and acid rain. The drying required with such low rank coals is a deep drying process to remove both surface water and large quantities of interstitial water present. The handling, storage and transportation of such deep dried coal can present technical problems resulting from the friability and dustiness of the coal, as well as its tendency to readsorb moisture and react with oxygen from the air. Spontaneous combustion can result from heats of moisture readsorption and oxidation. Removing moisture inherent in the coal structure can also reduce the strength of the coal particle by cracking or fissuring, causing friability and dusting. The number of active surface sites exposed within the coal particles can also thus be increased, thereby increasing undesired moisture adsorption and oxidation.

Drying conditions such as temperature, residence time within the drying chamber, drying gas velocities, etc., affect the tendencies of the dried coal product to exhibit the undesirable qualities discussed above. For example, rapid removal of moisture by a high drying temperature can cause what is commonly called "the popcorn effect"—the fissuring and cracking and disintegration of the coal particles. Drying the coal and removing the moisture at a slower rate can reduce this effect—preventing disintegration and allowing moisture to escape in a manner that reduces cracking and fissuring. Smaller fissures make the coal particles more amenable to surface treatment agents which block the pores or coat the particle uniformly and act as effective oxidation or moisture readsorption inhibitors. However, slower drying rates necessitate longer residence times in the drying chamber to achieve the same degree of moisture removal. Because of the turbulent action in a fluidized drying bed, longer residence time leads to increased mechanical size-degradation of the coal particles, increasing dust in the dried product.

SUMMARY OF THE INVENTION

Briefly stated, this invention comprises drying particulated sub-bituminous or lignitic coal under specified conditions of temperature and residence time in the dryer to a desired moisture content. Thereafter the dried particulated coal is sprayed or otherwise contacted with a liquid treating agent thereby reducing its tendency to adsorb moisture and/or to spontaneously ignite. The treating agent is a blend of clarified slurry oil and petroleum resid such as vacuum tower bottoms or a blend of vacuum tower bottoms and distillate, all derived in the refining of petroleum hydrocarbons. Preferably the liquid treating agent is a blend made up of 1 to 49 parts by volume of clarified slurry oil and 99 to 51 parts by volume of vacuum tower bottoms. A more preferred range is 5 to 10 parts of clarified slurry oil and correspondingly 95 to 90 parts of vacuum tower bottoms. Tests show a 50/50 mixture also works well. In making the blend of vacuum tower bottoms and distillate, distillate types such as kerosene, gas oil or diesel are mixed with petroleum resid in volume ratio of 15 to 5 parts by volume of distillate and 85 to 95 parts by volume of vacuum tower bottoms. Over this range the viscosity of the mixture will be less than 250 centistokes (measured at 100° C.) and the flash point will be less than 400° F.

DETAILED DESCRIPTION OF THE INVENTION

This invention is an improved method of reducing the tendency of dried particulated coal to disintegrate and ignite spontaneously. Coals may be dried to remove surface water or deep dried to remove interstitial water and thereby increase the heating value of the coal. In this description dried coal is coal that has been dried to remove some of the interstitial water and the moisture content of a dried coal as measured in accordance with the procedures set forth in ASTM D3173-73 entitled "Standard Test Method For Moisture in the Analysis Sample of Coal and Coke" published in the 1978 Annual Book of ASTM Standards, Part 26. Techniques for drying coal are discussed in U.S. Pat. Nos. 4,396,394 and 4,402,707 both of which are incorporated herein by reference. The method of this invention is applicable to all forms of dried coal, especially deep dried coal, but is especially useful for dried low rank coals such as sub-bituminous, lignite and brown coals.

In the method of this invention, the coal particles are first reduced to particles having a maximum diameter of 1 to 4 inches with an average diameter of about 0.2 to 0.5 inches. The particulated coal is then contacted with a heated stream of drying gas, preferably in a fluidized bed, at a temperature between about 190° F. and 230° F., (preferably 200° F. to 215° F.) for a contact period of between 1 and 15 minutes (preferably 3 to 7 minutes) so that the rate of evaporation of water is about 0.1 to 0.5 tons per hour (preferably 0.17 to 0.22 tons per hour) per ton of raw coal. The techniques for drying the particulated coal are set forth in the U.S. Pat. Nos. 4,396,394 and 4,402,707 noted previously. The dried particulated coal is then sprayed with the deactivating (passivating) oil composition which is a blend of vacuum tower bottoms and distillate or clarified slurry oil. Vacuum tower bottoms is the residue after petroleum crude oil is flashed to the atmosphere or to a lower pressure at temperatures above 500° F. Ordinarily it has an initial boiling point range of 600° to 1200° F. Clarified slurry oil is the highly aromatic fraction from catalytic cracking which boils above 600° F. Distillate materials include blended, straight run or cracked hydrocarbons having a boiling point between 350° and 1000° F., for example, kerosene, gas oil, and diesel fuel.

Preferably the oil has a characterization factor greater than 10.0. The characterization factor is a special physical property of hydrocarbons defined by the relationship:

$$K = \frac{T_b^{\frac{1}{3}}}{G}$$

where

K—Characterization factor $T_b$=Cubic average boiling point °R.

G=Specific gravity 60° F./60° F.

*R=°F.+460.

The cubic average boiling point is determined in accordance with the calculations mentioned in an article entitled "Boiling Points and Critical Properties of Hydrocarbon Mixtures," by R. L. Smith and K. M. Watson, appearing in Industrial and Engineering Chemistry, Volume 29, pages 1408–1414, December, 1937, and using the ten, thirty, fifty, seventy, and ninety percent points °F. as measured by the procedures of ASTM D1160-77, previously described or ASTM D86 entitled "Standard Method for Distillation of Petroleum Products", published in the 1978 Annual Book of ASTM Standards, Part 23. ASTM D86 is for products which decomose when distilled at atmospheric pressure.

Accordingly, in the method of this invention after the dried coal particles have been removed from the drying system they are contacted with the liquid treating agent of this invention by spraying or by other means of applying a thin coating. The liquid treating agent of this invention can be used in any desired quantity, but between 0.2 and 5 gallons of liquid per ton of dried coal will ordinarily be adequate. The preferred range is between 0.5 and 2 gallons of oil per ton of dried coal.

EXAMPLES

The passivating liquids of this invention were evaluated in a series of tests with clarified slurry oil and vacuum tower bottoms. For each test particulated coal was dried to below 0.5 wt.% moisture. Samples of the dried coal were sprayed with the liquid compositions shown in Table 1 in an amount of 2 gallons of liquid per ton of coal. Tests to determine tendency for spontaneous ignition were then made.

From the test results shown in Table 1 it is apparent that compositions made up of clarified slurry oil and vacuum tower bottoms are effective in rendering the particulated coal less susceptible to spontaneous combustion.

Visual observations of the treated samples indicated a reduction of dust after application of the inactivating agents.

TABLE 1

| Run No. | Composition of Passivating Agent | Viscosity Centipoises | Time in Hours to Induce Spontaneous Combustion |
|---|---|---|---|
| Untreated Dried Coal | | | 4–5 |
| 10 | 33% CSO & 67% LCO | 4.7 @ 80° C. | 5.65 |
| 11 | 33% CSO & 67% LCO | | 5.75 |
| 12 | 100% VTB | 234 @ 80° C. | NB |
| 13 | 100% VTB | | 3.25 |
| 16 | 10% CSO & 90% VTB | | NB*** |
| 17 | 100% VTB** | | NB*** |

NB = No burning
CSO = Clarified Slurry Oil
VTB = Vacuum Tower Bottoms
**Coal dried to a moisture content of 10 percent.
***No burning initiated in a second test.

We claim:

1. A method for producing a dried particulate coal fuel having a reduced tendency to ignite spontaneously comprising spraying and intimately mixing said dried coal with a deactivating composition selected from the group consisting of mixtures of about 1 to about 49 parts by volume of clarified slurry oil and about 99 to about 51 parts by volume of petroleum resid and between about 5 and about 15 parts by volume of mixtures of distillate and about 95 to 85 parts by volume of petroleum resid.

2. The method of claim 1 wherein each of said mixtures has a K value greater than about 10.0.

3. The method of claim 1 wherein said dried particulate coal is selected from the group consisting of subbituminous, lignite, brown coals and combinations thereof.

4. The method of claim 1 wherein said dried coal is sprayed with between about 0.2 and about 5 gallons of deactivating composition per ton of coal.

5. The method of claim 1 wherein said dried coal is sprayed with between about 0.5 and about 2 gallons of deactivating composition per ton of coal.

6. The method of claim 1 wherein said deactivation composition is a mixture of about 10 parts by volume of clarified slurry oil to about 90 parts by volume of vacuum tower bottoms.

7. The method of claim 1 wherein said deactivation composition is a mixture of about 50 parts by volume of clarified slurry oil to about 50 parts by volume of vacuum tower bottom.

8. The method of claim 1 wherein said distillate is selected from the group consisting of blended, straight run, or cracked hydrocarbons and mixtures thereof.

9. The method of claim 1 wherein said deactivating composition is a mixture of about 10 parts by volume of distillate to about 90 parts by volume of petroleum resid.

* * * * *